United States Patent [19]

Spaziante

[11] Patent Number: 4,488,945

[45] Date of Patent: Dec. 18, 1984

[54] PROCESS FOR PRODUCING HYPOCHLORITE

[75] Inventor: Placido M. Spaziante, Comano, Switzerland

[73] Assignee: Panclor S.A., Comano, Switzerland

[21] Appl. No.: 543,366

[22] Filed: Oct. 19, 1983

[30] Foreign Application Priority Data

Oct. 27, 1982 [CH] Switzerland ..... 6257/82

[51] Int. Cl.[3] ..... C25B 1/26

[52] U.S. Cl. ..... 204/95; 204/98; 204/128; 204/267

[58] Field of Search ..... 204/95, 98, 128, 237, 204/267–270, 290 F

[56] References Cited

U.S. PATENT DOCUMENTS 3,660,261 5/1972 Wright et al. ..... 204/98
4,085,014 4/1978 Bennett et al. ..... 204/95
4,108,756 8/1978 De Nora et al. ..... 204/95
4,130,468 12/1978 De Nora et al. ..... 204/98
4,174,266 11/1979 Jeffery ..... 204/98

*Primary Examiner*—R. L. Andrews
*Assistant Examiner*—Terryence Chapman
*Attorney, Agent, or Firm*—Charles A. Muserlian

[57] ABSTRACT

In a process for the electrolysis of sea water to produce hypochlorite in at least one electrolysis cell equipped with anodes and cathodes forming interelectrodic spaces, the improvement comprising admixing sea water before electrolysis with sufficient hypochlorite solution to substantially oxidize bromine, iodine and sulfur ion impurities to their elemental forms and an apparatus for said process. Preferably, the hypochlorite solution is recycled from an electrolysis cell and the ratio of recycle liquid to sea water is adjusted to increase the temperature of the sea water mixture to at least 9.6° C.

5 Claims, 5 Drawing Figures

SECTION X-X

PROCESS FOR PRODUCING HYPOCHLORITE

STATE OF THE ART

Figure 1:
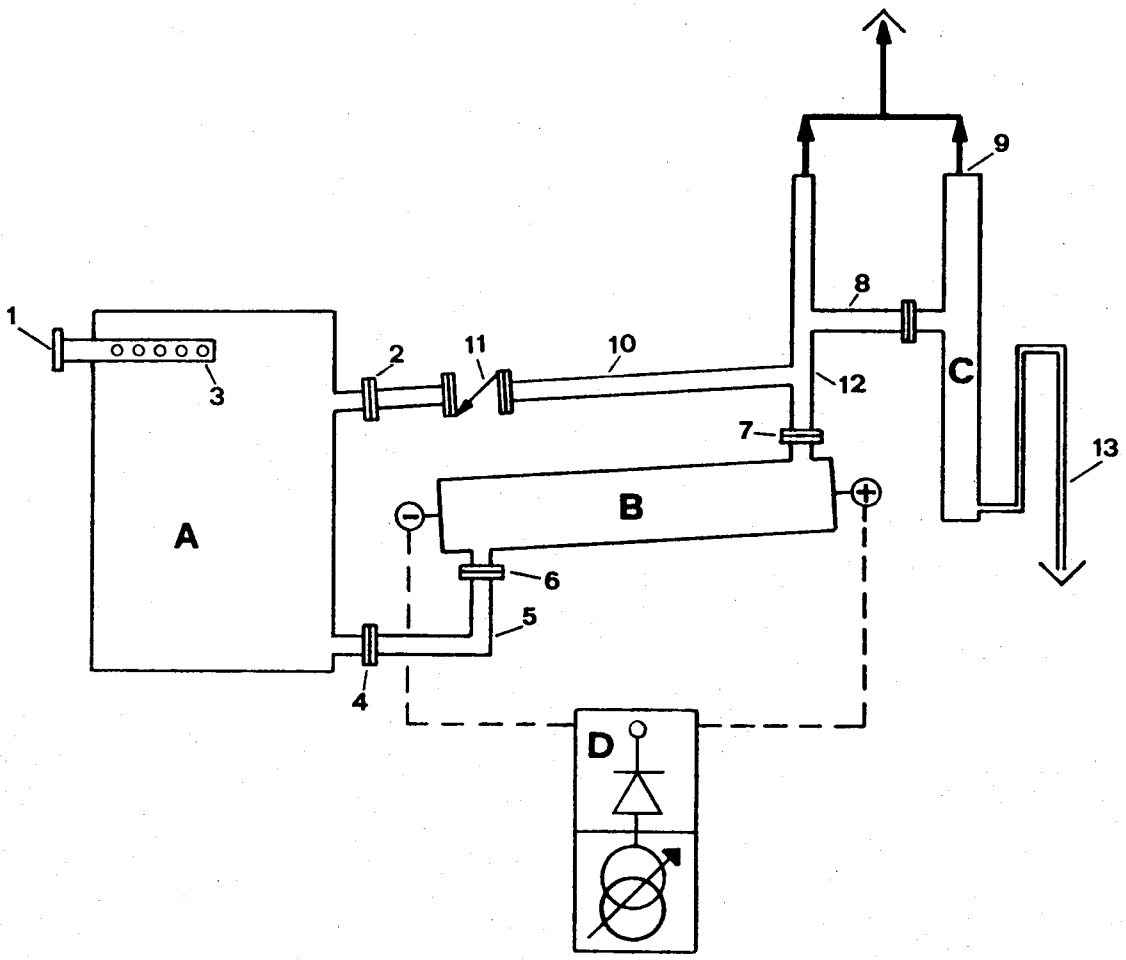

The electrolysis of sea water is commonly used for the direct production of hypochlorite to prevent biofouling and scaling of cooling systems and this process, which is much safer and more economical than the addition of gaseous chlorine to the sea water cooling circuit, presents a series of problems connected to the impurities present in the sea water. It is known that sea water contains, in addition to sodium chloride, which is the starting material for the production of hypochlorite, other ions which interfere with the process. The fundamental reactions occurring when a direct current flows through the sea water in the cell are the following:

At the anode—production of chlorine $$2Cl^- \rightarrow Cl_2 + 2e \qquad \text{I}$$

At the cathode—generation of hydrogen and formation of hydroxide ions $$2H_2O + 2e \rightarrow 2OH^- + H_2 \qquad \text{II}$$

In the gap between the electrodes: direct interaction between chlorine and hydroxide ion which generates hypochlorite $$Cl_2 + 2OH^- \rightarrow H_2O + ClO^- + Cl^- \qquad \text{III}$$

The hypochlorite has a specific oxidizing and sterilizing effect and has the advantage of regenerating the original chloride ion when in contact with organic substances or through the effect of light, heat or easily oxidizable ions resulting in no noxious residues being left in the sea water after the sterilization process.

Reaction I is not the only reaction occurring at the anode during sea water electrolysis since other competitive reactions occur favored by the low concentration of sodium chloride and the presence of impurities. In particular, the following anodic reactions take place to some extent:

Anodic oxygen evolution $$4OH^- \rightarrow O_2 + 2H_2O + 4e \qquad \text{IV}$$

Evolution of bromine from bromide $$2Br^- \rightarrow Br_2 + 2e \qquad \text{V}$$

Evolution of iodine from iodides $$2I^- \rightarrow I_2 + 2e \qquad \text{VI}$$

Formation of sulfur from sulfides $$S^= \rightarrow S + 2e \qquad \text{VII}$$

Reaction IV occurs at an electrochemical potential very close to that of reaction I and it not only contributes towards the low efficiency of the process, but also causes a marked deterioration of the anode which deterioration is dramatic if graphite or carbon is used as anode, but to a lesser extent, although still significant, in the case of anodes made of titanium activated by noble metal or metal oxides. Reaction V occurs since bromides are present in sea water at an average concentration of 65 ppm (*CRC Handbook of Chemistry and Physics*, F-203, 58th edition). Even if the concentration is low, the evolution of bromine from bromide is favored because the electrodic potential of reaction V (1.06 V) is much lower than that of reaction I (1.36 V). The same occurs for the evolution of iodine and even if its concentration in sea water is rather small (0.05–0.1 ppm), the electrodic potential of reaction VI makes this reaction extremely favored.

Both reactions V and VI, even if they do not decrease the efficiency of the process (the sterilizing power of bromine and iodine is comparable with, or even stronger than that of chlorine), they have a detrimental effect on the electrodic structure which structure used nowadays is made of titanium coated with noble metals or oxides catalytic to chlorine evolution. Titanium is a valve metal which resists under anodic conditions because of its peculiarity of forming a protective oxide film resistant to an anodic potential of several volts. In the presence of an aqueous solution containing chlorides, the breakdown voltage of this film, i.e. the anodic voltage that breaks the oxide film making possible the dissolution of titanium, varies between 9 and 12 V depending on the temperature, salt concentration, pH, etc. Under the conditions of sea water electrolysis, the anodic potential applied to the anode is not higher than 2 to 3 V, far below the breakdown voltage.

When small quantities of bromides or iodides are present in solution, the breakdown voltage of titanium is greatly reduced, and the titanium structure of the electrode undergoes severe corrosion. It is known that in the electrochemical process of chlorine production, the presence of even traces of bromide or iodide ions in the brine will cause a rapid destruction of the titanium anode. Other valve metals which have a higher breakdown voltage and could avoid this problem exist such as tantalum, tungsten, etc., but their cost is prohibitive and their availability is very limited. Therefore, the only solution for the chlorine generation plant is that of using bromide- and iodide-free sodium chloride.

Another impurity not typical of sea water composition but which may be present because of sewage or industrial discharge is the sulfide ion which has an oxidation potential (0.508 V) much lower than that of chlorine, and, therefore, reaction VI will be favored and occur before chlorine evolution. The electrodic reactions which involve sulfides are much more complex and may involve a partial anodic oxidation of sulfides to species containing sulfur in a higher oxidation state which, transferred by the flow of the sea water to the cathode, may generate sulfur deposition on the cathode. It is known that when electrolyzing an aqueous solution containing sulfides, an anodic, as well as cathodic, deposition of sulfur occurs which deposit polarizes the anode, deactivating the coating and promoting destructive corrosion.

Methods for eliminating cathodic deposition of sulfur by using a higher current density to reduce the sulfur to hydrogen sulfides have been suggested but no solution has been found to prevent corrosion of anodes. In the process of chlorine production from brine, it is normal practice to use a pure salt, or simply to purify the brine sent to the cell circuit in view of the small volume of brine involved, but in the case of sea water, where the volume is far greater and the concentration of impurities higher, such a purification process is not economical. In general, the volume of sea water sent to the electrolyzers is between 500–1000 liters per kg of chlorine produced, while in the case of the production of gaseous chlorine from brine, the volume of brine sent to the cell circuit is between 5–10 liters/kg of chlorine$_2$. Therefore, in a plant for sea water electrolysis, a limited electrolytic life and frequent maintenance are inevitable and in some cases the electrolytic method has to be abandoned because of these impurities.

Other impurities present in sea water which also produce cathodic scaling are calcium and magnesium and this scaling is porous and does not interfere with the normal functioning of the cell, but does increase the operating voltage and may prevent electrolyte flow if allowed to build up to considerable thicknesses. In addition, this scaling can be easily removed with an acid washing without opening the cells.

Another problem that sea water electrolysis faces, especially in the northern regions, is sea water temperature. When the temperature is below 10° C., a rapid deterioration of the anodes is observed and the mechanism of this process is not completely understood, although it is believed that the deterioration process occurs because of the formation of a solid layer of chlorine hydrate ($Cl_2.8H_2O$, melting point 9.6° C.) on the anode. This layer passivates the anode by reducing the active area, thereby increasing the local current density and this is especially true in the case of dilute sea water in brine and leads to severe corrosion. No solution has yet been found to overcome this problem.

Heating the sea water before entering the cell is not economically convenient due to the large quantity of sea water involved, and to the expensive equipment which has to withstand sea water corrosive characteristics. In most northern regions, temperatures below 10° C. are common for almost half the year, and the normal practice is not to use electrolytic chlorination of water or to reduce the current density of the cell to delay anodic corrosion. At a temperature of 4° C., the problem becomes dramatic, and generally the electrochlorinators have to be left idle in spite of the need for a certain quantity of chlorine in the cooling circuit, not only to prevent the marine growth which is still existent though reduced, but mainly to adjust the redox potential of the sea water to prevent corrosion of the heat exchangers.

OBJECTS OF THE INVENTION

It is an object of the invention to provide an improved novel process for the production of hypochlorite by electrolysis of sea water free of the prior art problems.

It is a further object of the invention to provide a novel apparatus for trouble-free electrolysis of sea water.

These and other objects and advantages of the invention will become obvious from the following detailed description.

THE INVENTION

The process of the invention for electrolysis of sea water to produce hypochlorite in an electrolysis cell equipped with anodes and cathodes forming an interelectrodic gap, the improvement comprises admixing sea water before electrolysis with sufficient hypochlorite solution to substantially oxidize bromine, iodine and/or sulfur ion impurities to their elemental forms. Preferably, the hypochlorite solution is recycled from the electrolytic cell and sufficient hypochlorite solution is used to adjust the temperature of the sea water feed to the electrolytic cell to at least 9.6° C.

The process can be easily effected by placing a reactor of suitable dimensions just before the electrolytic cell for mixing a portion of the hypochlorite produced in the cell with the sea water entering the system. The hypochlorite is sent to the reactor without the use of a pump by using only the lifting effect of the hydrogen that evolves in the cell. The solution coming out of the electrolytic cell contains active chlorine between 1–5 gpl and is able to oxidize the impurities such as $Br^-$, $I^-$ and $S^=$ contained in the sea water. Since these impurities are in general in a very low percentage of a few ppms, only a limited quantity of hypochlorite is necessary to obtain the desired result. In addition, considering that the sea water that goes through the electrolytic cell undergoes an increase of temperature due to the heat evolved by the electrode overpotentials, to the "Joule" effect in the electrical conductors and to the heat evolved by reaction III, it is possible, by mixing the hot hypochlorite coming out of the electrolyzer with the sea water entering the system, to obtain a temperature increase to avoid the problems mentioned above.

The principal purpose of this invention is, therefore, a new method to improve in-situ the chemical characteristics of the sea water that is sent to an electrochlorination cell and to increase the temperature of the sea water entering the electrolytic cell utilizing part of the heat evolved in the cell itself. The process also increases the life of the electrodes, specifically that of the first electrolytic cell when several cells are used in series by the pretreatment of the sea water since all oxidizable anions such as $Br^-$, $I^-$ and $S^=$ present in the sea water are oxidized so as to protect the electrodes.

The apparatus of the invention is comprised of mixing means for mixing sea water and recycle hypochlorite solution, at least one electrolytic cell connected to the mixing means equipped with anodes and cathodes forming an interelectrodic gap, means for recovering hypochlorite solution and hydrogen from the cell, means for separating hydrogen from the hypochlorite solution and recovering hypochlorite solutions for use, means of recycling a portion of hypochlorite solution to the mixing means and means for supplying direct current to the electrolytic cell.

The production of hypochlorite "in situ" using sea water is becoming increasingly popular due to the simplicity of the process as well as for economical reasons and by using this method, problems connected with the dangers of transporting gaseous chlorine, and with the high transport cost of dilute hypochlorite solutions which, because of their instability present preservation difficulties, are entirely eliminated. The technological development of dimensionally stable electrodes allows for the realization of various electrolytic cells for this purpose such as U.S. Pat. No. 4,248,690 and U.S. Pat. No. 4,124,480.

However, drawbacks in the prior art processes still encountered are those due to the impurities contained in sea water which prevent the complete automation of the plants and which are the cause of expensive maintenance, and the low sea water temperature which reduces the electrode life. Sea water contains dissolved substances such as bromides and iodides which lower the breakdown potential of the protective film of the titanium anodes to below that used in cells for the chlorine discharge giving rise to corrosion phenomena. Further, the presence of sulfides, typical of costal waters which receive the discharge of sewage treatment plants, creates passivating deposits on the electrodes resulting in rapid destruction thereof. Even if the sulfide concentration concentration is generally very low, there exists the phenomena of accumulation of sulfur deposit on the electrodes which is quite considerable in view of the large quantity of sea water used for the electrolysis.

In fact, it is quite common to obtain solutions containing 1 or 2 g/l of chlorine at the outlet of the electrolyzers since higher concentrations of chlorine, and thus lower inlet flow of sea water, are not economically feasible because the higher the concentration of chlorine, the lower the yield of the process. This drop in efficiency is principally due to the cathodic reduction of hypochlorous acid to chloride, the rate of which is proportional to the chlorine concentration. In addition, the direct electrolysis of sea water cannot be utilized in winter in areas where the sea water temperature drops below 10° C. since the life of the anodes become very short.

The present invention solves all these problems by putting before the electrolytic cell a reactor of the appropriate dimensions in which the sea water entering the system and part of the hypochlorite leaving the cell are mixed.

Figure 2:
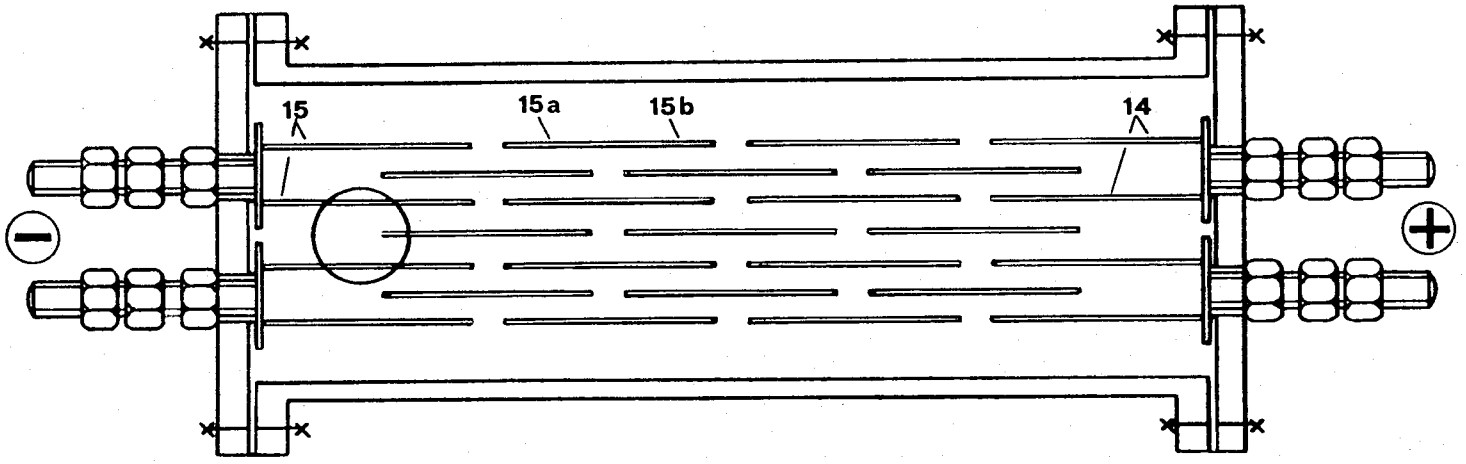
Figure 2A:
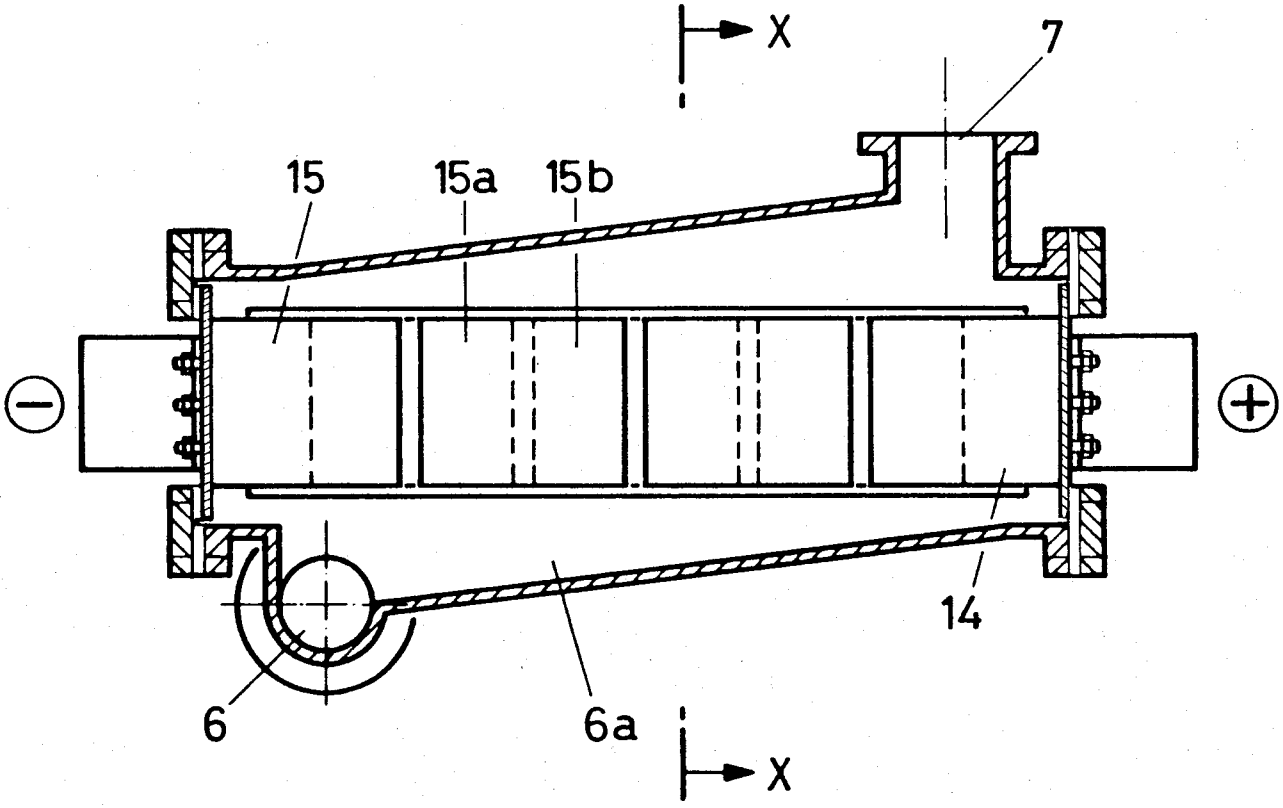
Figure 2B:
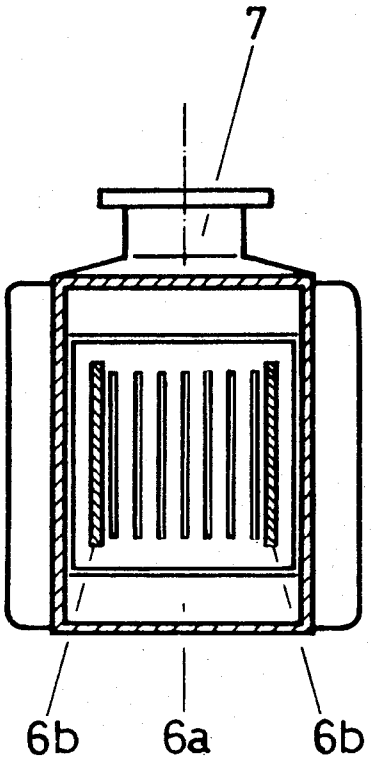
Figure 3:
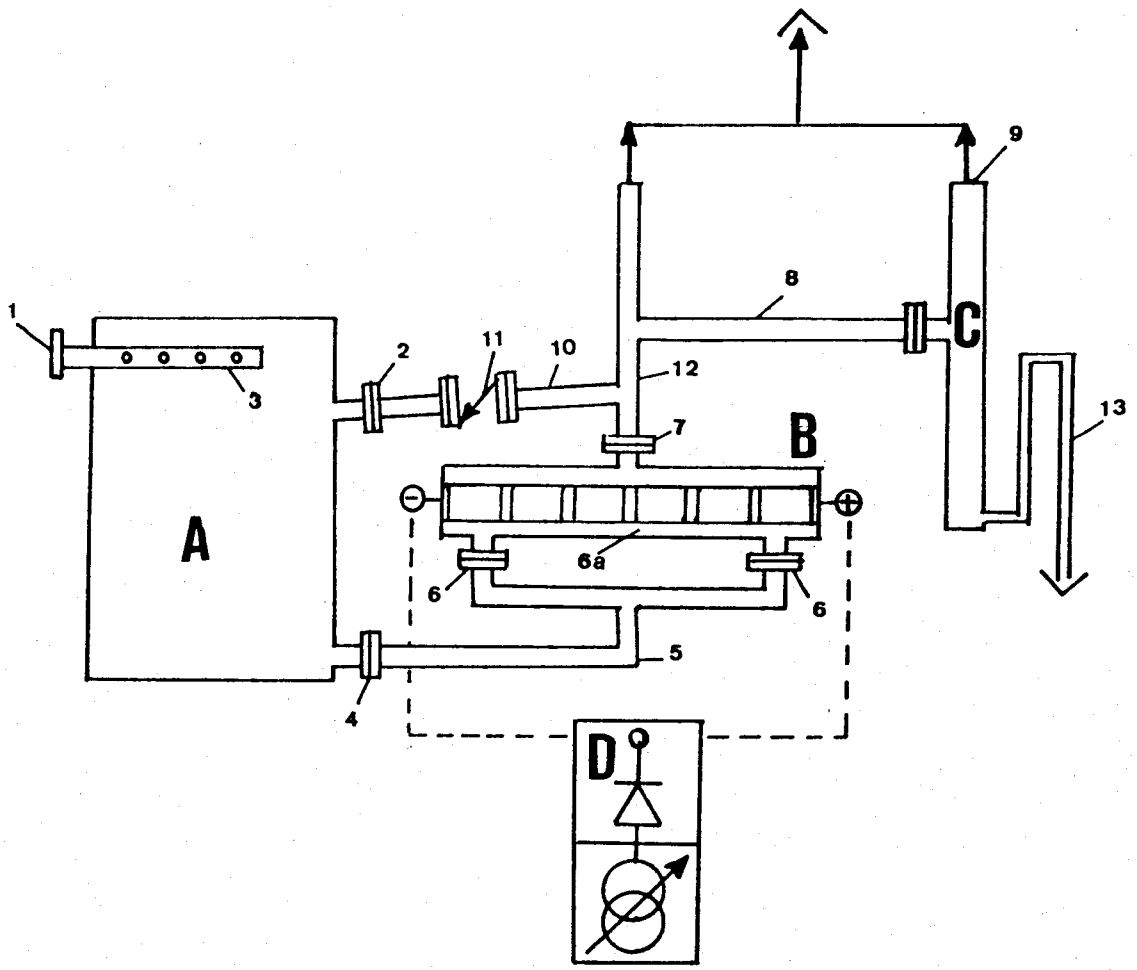

Referring to the drawings:

FIG. 1 is a schematic outline of one embodiment of an apparatus of the invention for effecting the process;

FIG. 2*a* is a vertical section of the electrolytic cell of FIG. 1, FIG. 2*b* is a cross section of the electrolytic cell of FIG. 1 and FIG. 2*c* is a horizontal section of the electrolyzer of FIG. 1 and;

FIG. 3 is a modification of the apparatus of the invention where the sea water is uniformly fed to the cell.

In the reactor A which is a cylindrical tank, the sea water is fed through inlet 1 and, simultaneously, part of the hypochlorite produced enters through inlet 2. The inlets 1 and 2 are placed at the upper part of the tank A and a distributor 3 can be used to distribute the sea water if reactor A is of large dimensions. The outlet 4, which is placed at the lowest part of the tank, permits the treated sea water to reach electrolyzer B by entering through inlet 6 placed at the lowest part of the electrolyzer in FIG. 1. Alternatively, the sea water coming from the reactor can be fed simultaneously to the opposite end of the electrolyzer and be distributed uniformly to the cell along the channel 6*a* of FIG. 3.

Since the single cells of the electrolyzer are fed with sea water simultaneously in parallel, it is of utmost importance that the sea water distribution be as uniform as possible since if one cell is fed with less sea water than the others, the resultant concentration of chlorine in the sea water coming out of this cell will be correspondingly higher and its efficiency correspondingly lower. The cells, electrically in series, produce equal quantities of chlorine and it is known that the efficiency of the cell, when operated with dilute brine or sea water, drops drastically for concentration of chlorine higher than 2 gpl, and is reduced to almost zero for concentration over 5–8 gpl depending on the chloride concentration.

For example, if in one cell the flow of the sea water is 3 times lower than that of the other cells, the corresponding concentration of chlorine in the outlet of this cell will be three times the concentration of chlorine in the bulk of the solution. If the concentration of the bulk of the solution at the outlet of the cell is kept, for example, to 2 gpl, the concentration of chlorine at the outlet of the cell with $\frac{1}{3}$ flow should be $3\times2$ (=6 gpl) and the corresponding efficiency reduced to almost zero.

In the electrolyzer represented in FIGS. 2*a*, 2*b* and 2*c*, the uniformity of the sea water flow to the cells is obtained by the properly designed channel 6*a*. From the prior art of distributors and diffusers, it is known that a good distribution of liquid is obtained when the pressure drop across the opening of the distributors is at least 10 times larger than the pressure drop in the main channel. In the electrolyzer of this invention, it has been found that good distribution, and therefore higher efficiency, is obtained by using a distribution channel 6*a* having a hydraulic radius of at least 50 (preferably 100) times greater than that of the single cells. It has also been found that tapered channels for both sea water distribution and hypochlorite recollection serve better the purpose.

The hypochlorite and hydrogen produced are removed together from the electrolyzer through outlet 7 and part of the hypochlorite is sent back to reactor A through pipe 10, and the remainder is sent through pipe 8 to a phase separator C from which hydrogen is sent to the atmosphere through outlet 9 and hypochlorite is sent to utilization through pipe 13. The hypochlorite is sent to reactor A automatically and continuously because of the lower density of the mixture of hydrogen/hypochlorite in the cell and in the vertical pipe 12 compared with the density of sea water in reactor A. Check valve 11 in pipe 10 prevents the sea water from going from tank A to separator C without passing through the cell B.

The chemical reactions occurring in the reactor are the following:

bromide elimination $$2Br^- + Cl_2 \rightarrow 2Cl^- + Br_2 \qquad \text{VIII}$$

iodide elimination $$2I^- + Cl_2 \rightarrow I_2 + 2Cl^- \qquad \text{IX}$$

sulfide elimination $$S^= + Cl_2 \rightarrow S + 2Cl^- \qquad \text{X}$$

In reactor A, active chlorine oxidizes completely bromide, iodide and sulfide ions contained in the sea water, giving elemental bromine, iodine and sulfur which are innocuous to the electrodes. Reactions VIII, IX and X are ionic reactions and occur very rapidly as soon as hypochlorite is mixed with the sea water and it has been experimentally found that a residence time of less than a minute is sufficient to obtain the desired result. In practice, bromine and iodine will not remain in the elemental form, but will react either with chlorine, giving interhalogen compounds, or with water, giving hypohalogenites.

To ensure a sufficient flow of hypochlorite recirculating to reactor A, it is important that the cell and the piping have a low hydraulic pressure drop. Therefore, the piping has to be of sufficient diameter to allow a velocity of preferably less than 1 m/sec, and the cell has to have a very low pressure drop. A typical example of such a cell is described in U.S. Pat. No. 4,032,426. In this way, the sea water enters reactor A, flows freely through pipes 5, 8 and 13, and enters equipment B and C without the need of controlling the flow, level and pressure.

A cell of improved design for the purpose of this invention is represented in FIGS. *2a, 2b* and *2c*. The conversion unit D of FIG. 1 provides continuous current of positive polarity to the anodes 14 and negative polarity to the cathodes 15 and the remaining electrodes, also vertically disposed blade type, are anodic on both sides of one end (15A) and cathodic on both sides of the opposite end (15B). All electrodes blades are kept in position by insulating walls *6b*.

In the following examples there are described several preferred embodiments to illustrate the invention. However, it should be understood that the invention is not intended to be limited to the specific embodiments.

EXAMPLE 1

The apparatus described in FIG. 1 was used with the reactor having a 100 mm diameter and being 1.6 m high. The electrolyzer consisted of 8 cells in series with flat shaped titanium electrodes, 1 mm thick anodically coated with a metal oxide coating electrocatalytic to chlorine evolution which were vertically disposed in a 50 mm diameter tube of 1 m length. The electrodic blades were 200 mm long and 25 mm high. The cathodic head was composed of four blades of uncoated titanium joined to the negative pole of a current rectifier between which the anodic part of a bipolar blade were inserted so as to form an electrolytic cell with a gap of 3 mm.

25 other blades were placed in the pipe to form eight cells with the electrodic area of each cell measuring 1.5 $dm^2$. The electrolyzer was connected to a current rectifier (15 A, 40 V) and the pipe connecting the electrolyzer to the reactor was 20 mm in diameter. Synthetically prepared sea water was sent continuously to the reactor at a rate of 140 l/h and at a temperature of 18° C. and the same flow was removed by overflow from the degasing tank. Operating the 8 cells in series at the load of 15 A, an hypochlorite solution containing approximately 1 g/l was obtained. The flow in the pipe connecting the degasing tank with the reactor was measured and was found to be approximately 500 l/h. The faraday efficiency measured was 88% and the faraday efficiency without the recirculation was 85%.

EXAMPLE 2

Utilizing the same equipment described in Example 1 and operating at the same conditions, sodium sulfide was added in the range from 10 to 200 ppm to the synthetic sea water. After several days of operation, no deposits were formed on the electrode. Operating the unit without the recirculation, a white deposit occurred starting from the edges of the anodes after only a few hours of operation and the cell voltage increased by 0.3 V after 5 hours of operation. The analysis showed that the white deposit was elemental sulfur.

EXAMPLE 3

Utilizing the same equipment described in Example 1, a synthetic sea water was sent to the reactor at 4° C. and the cell was operated at 20 A and the corresponding voltage of the electrolyzer at the start was 45 V. The sea water flow was kept at 90 l/h and after 2 hours of operation allowing free recirculation of the electrolyte, the temperature of the system increased from 4° C. to 11° C. and this temperature remained constant keeping the sea water flow and the load at the same value. The measured hypochlorite concentration in the sea water leaving the plant was 2 g/l corresponding to a faraday efficiency of 85%. The voltage of the system was reduced to 40 V and it was noted that the temperature of the system could be further increased by reducing the sea water flow or by increasing the load.

EXAMPLE 4

A plant similar to that described in FIG. 3 was used and the reactor was 200 mm in diameter and 1.5 m high. The electrolyzer consisted of 6 cells in series enclosed in a 200 mm pipe and the bipolar electrode blades were 400 mm long and 100 mm high. Each cell consisted of 8 blades intermeshed with another 8 blades of the opposite polarity thus having an area of 0.32 $m^2$. The electrolyzer was connected to a rectifier capable of supplying 500 A at 35 V and the pipe connecting the electrolyzer to the reactor was 80 mm in diameter. Sea water was sent continuously to the reactor at a rate of 3 $m^3/h$ and at a temperature of 7° C. while the same flow was removed by overflow from the degasing tank. Operating the 6 cells in series at the load of 500 A, an hypochlorite solution containing approximately over 1.1 g/l was obtained. The flow in the pipe connecting the degasing tank with the reactor was measured and was found to be approximately 10 $m^3/h$. The faraday efficiency measured was 85% compared to the faraday efficiency without the recirculation of 83%. The temperature of the electrolyte entering the electrolyzer was found to be about 10° C.

Various modifications of the process and apparatus of the invention may be made without departing from the spirit or scope thereof and it is to be understood that the invention is intended to be limited only as defined in the appended claims.

What I claim is:

1. A process for the electrolysis of sea water to produce hypochlorite in at least one electrolysis cell equipped with anodes and cathodes forming interelectrodic spaces, the improvement comprising admixing sea water before electrolysis with sufficient hypochlorite solution recycled from the electrolyzer to substantially oxidize bromine, iodine and sulfur impurities to their elemental forms and to maintain the temperature of the sea water feed to the electrolyzer at not less than 9.6° C.

2. The process of claim 1 wherein the ratio of sea water to hypochlorite recycle solution is varied from 0.1 to 10 to 1.

3. The process of claim 1 wherein either the sea water or hypochlorite solution is fed through a distributor for uniform mixing.

4. The process of claim 1 wherein the residence time of the sea water is 10 to 160 seconds.

5. The process of claim 1 wherein the residence time of the sea water is 20 to 60 seconds.

* * * * *